United States Patent [19]

Cutrara

[11] Patent Number: 4,597,189

[45] Date of Patent: Jul. 1, 1986

[54] PACKAGED KILN DRIED FIREWOOD

[76] Inventor: Anthony Cutrara, R.R. #2, Burks Falls, P0A 1C0, Canada

[21] Appl. No.: 556,574

[22] Filed: Nov. 30, 1983

[51] Int. Cl.[4] ..... F26B 3/04

[52] U.S. Cl. ..... 34/38; 34/218; 53/440; 53/442; 206/497

[58] Field of Search ..... 34/13.8, 38, 218; 206/497, 443; 53/440, 442, 127, 557

[56] References Cited

U.S. PATENT DOCUMENTS

| | | | |
|---|---|---|---|
| 2,834,120 | 5/1958 | Greenhood | 34/38 |
| 3,939,573 | 2/1976 | Berti | 34/26 |
| 4,289,237 | 9/1981 | Cutrara | 206/497 |
| 4,294,295 | 10/1981 | Olin | 83/159 |

*Primary Examiner*—Larry I. Schwartz
*Attorney, Agent, or Firm*—Sim & McBurney

[57] ABSTRACT

A process for kiln drying firewood comprises splitting essentially uniform lengths of green tree logs to form firewood pieces. The green firewood pieces are placed in a kiln drying oven and dried at temperatures in excess of 150° F. by moving heated air over the pieces until they have an overall moisture content ranging from 15% up to 30% by weight. The firewood pieces are removed for subsequent distribution and use. The kiln dried firewood pieces have an outer layer of a moisture content which is sufficiently low to permit igniting of the firewood with ignited paper or the like without requiring the use of kindling wood.

10 Claims, 8 Drawing Figures

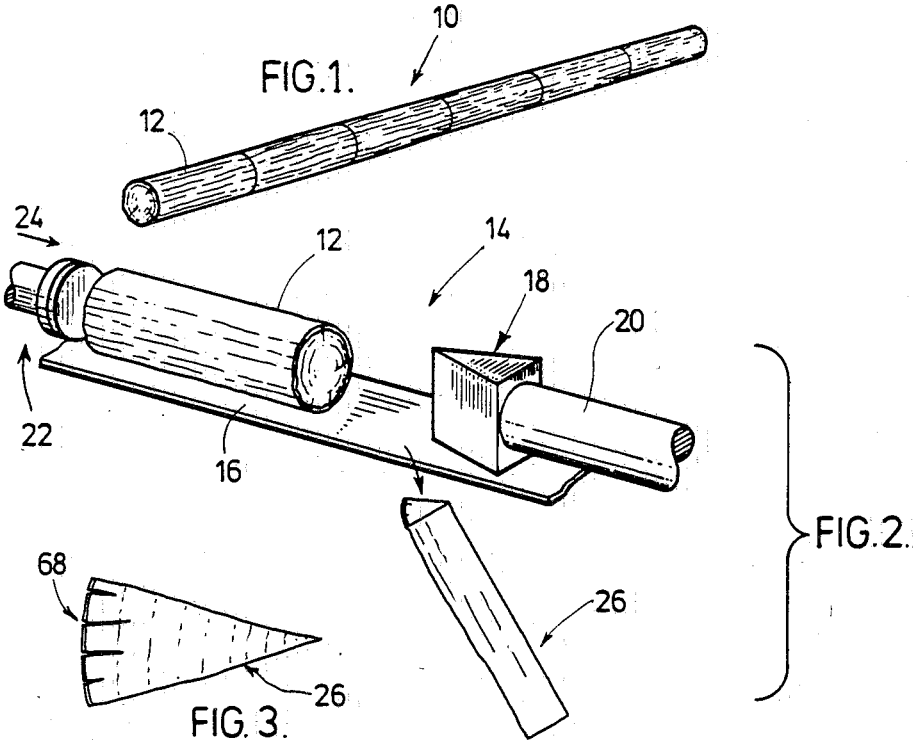
10
FIG.1.
12
24
12
14
18
20
22
16
26
FIG.2.
68
26
FIG. 3.
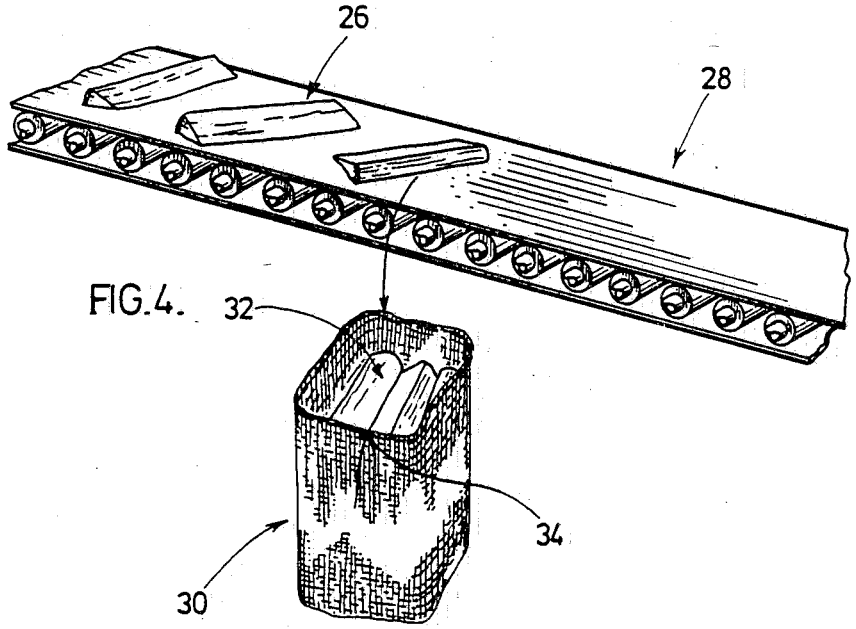
26
28
FIG.4.
32
34
30

PACKAGED KILN DRIED FIREWOOD

FIELD OF THE INVENTION

This invention relates to firewood and more particularly the technique of kiln drying firewood split from logs of felled trees.

BACKGROUND OF THE INVENTION

The art of seasoning firewood is a long and involved process where existing procedures of felling the trees allow them to lie in the field and are then sawed up into uniform lengths which can be split into firewood pieces. When the logs are split, the pieces are stacked usually in a covered area to complete the seasoning process. To provide proper firewood, this process can take anywhere from one to three years depending upon the type of firewood. Since the use of firewood is based on a seasonal demand, it is difficult for firewood suppliers to estimate in advance the amount of firewood they would need one to three years in the future. As a result, firewood suppliers find themselves in very much a cyclic situation where they may have an oversupply in one season and a shortage in another season.

In the normal seasoning process, firewood pieces can collect mold and mildew and can collect dirt over time. Thus the firewood pieces become unattractive, particularly to the consumer who may only use firewood on an occasional basis. For the occasional firewood user, packaged firewood has been provided in the form as disclosed in Canadian Pat. No. 1,116,134 and corresponding U.S. Pat. No. 4,289,237. However, the packaging of the firewood in that manner still requires a lengthy seasoning technique.

It has been discovered that a very acceptable firewood product can be provided by kiln drying firewood pieces split from green firewood tree logs. Although kiln drying is used to dry and cure building lumber, the lumber is dried over extended lengths of time to avoid checking or cracking on the wood surface as caused by too rapid removal of moisture from the lumber. Normally lumber kilns operate at temperture ranges of 110° to 150° F. where initial drying commences at the lower temperature. U.S. Pat. No. 4,196,526 exemplifies the use of higher temperatures at the later stage of the drying, but requires a complex unit to accomplish drying at these higher temperatures in the range of 140° to 145° F. Under very special circumstances during the latter part of the drying of dressed lumber, it is suggested that the kiln temperature may be raised to around 175° F., but this requires the use of special refrigeration units to allow drying at these temperatures which would not induce cracking in the wood surface. Another procedure is disclosed in U.S. Pat. No. 3,939,573 where lower drying temperatures are used. The principal drying temperature is in the range of 70° F. up to 85° F. and during the latter stages of the drying, the temperature of the ambient drying air may range from 90° F. up to 100° F.

It has been discovered that kiln drying freshly cut firewood logs at temperatures in excess of 150° F. to commence a rapid removal of moisture from the firewood pieces provides many unexpected advantages which become apparent in the following description of the invention.

SUMMARY OF THE INVENTION

According to an aspect of the invention, the process for kiln drying firewood comprises splitting lengths of green tree logs to form firewood pieces and placing the split firewood pieces in open mesh bags to provide a plurality of bags of firewood. The plurality of bags of green firewood pieces are placed in a kiln drying oven. The pieces are kiln dried at temperature in excess of 150° F. by moving heated air over the pieces until the pieces have an overall moisture content ranging from 15% up to 30% by weight. The kiln is operated at a temperature below a level which would render the structural characteristics of the bag useless and removing the kiln dried firewood pieces in the plurality of bags from the kiln drying oven.

BRIEF DESCRIPTION OF THE DRAWINGS

Preferred embodiments of the invention are shown in the drawings wherein:

FIG. 1 is a perspective view of an exemplary felled tree log which is cut into approximately equal lengths;

FIG. 2 is a perspective view of a log splitter for splitting the lengths of green firewood tree logs of FIG. 1;

FIG. 3 is an end view of a firewood piece which has been kiln dried;

FIG. 4 shows the conveying of the freshly split green firewood pieces which are placed in a bag prior to kiln drying;

DETAILED DESCRIPTION OF THE PREFERRED EMBODIMENTS

Figure 5:
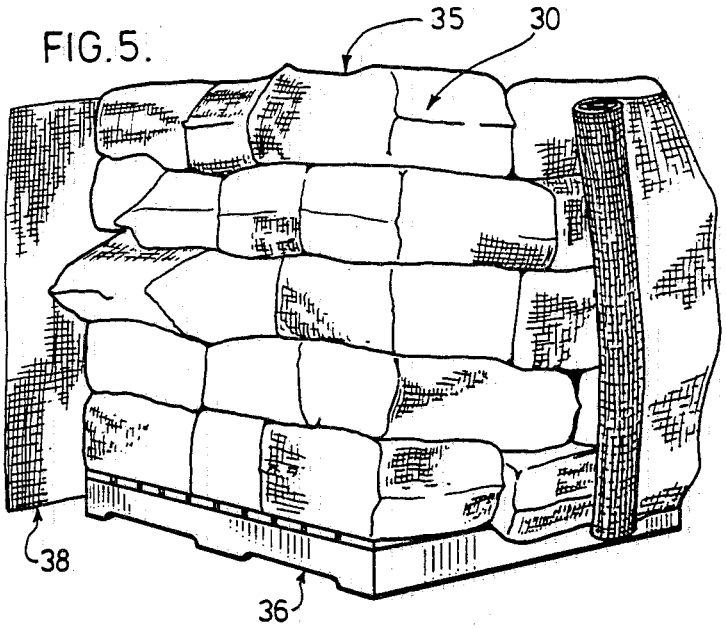
FIG. 5 shows the stacking on a pallet of the bagged green firewood pieces where the stack is wrapped with an open mesh netting to secure the stack on the pallet.

A felled tree log 10 is schematically shown in FIG. 1 where the tree may have been freshly cut. The branches and scrub material have been trimmed off in preparation for sawing the log into firewood log lengths 12. These may be the standard firewood log lengths of twelve inch, fourteen inch and sixteen inch. In the past, the tree log 10 was allowed to lie in the field for six months or more during the initial seasoning process. Should there be rot present in the log, then the rotting is expedited while the log is lying in the field.

According to a preferred embodiment of this invention, the freshly felled tree is immediately sawed up into the lengths 12 and passed on to a log splitter 14. The log lengths 12 are placed on a platform 16 in front of a wedge 18 which is fixed by post 20. A ram 22 advances the log in the direction of arrow 24 against the wedge 18 to split the log into firewood pieces 26. This technique is well understood by those skilled in the art, where depending upon the size of the log, the pieces formed during each splitting operation may be resplit until all pieces 26 are of a hand held size. Ideally the pieces should be roughly the same cross-sectional dimension so that a majority of pieces in each batch being dried in a kiln are dried to essentialy the same extent.

The freshly split green firewood pieces are then placed onto a conveyor 28 as they are removed from the splitter device 14. As is understood by those skilled in the art, the use of the term "green" defines the state of the wood in that it has not been cured to any extent and has a high moisture content. For example, green wood may be wood that has been felled no more than a month. According to an aspect of this invention, wood which has been felled within the day may be processed into split green pieces 26 which, as they progress along conveyor 28, are removed therefrom and hand placed into bags 30 in a stacked form as shown at 32 to form a square shape to the bag where the bag volume determines the number of pieces that each bag will hold. The bag includes a plastic drawstring 34 at its upper portion which is drawn closed when the bag is sufficiently full. Various materials may be used in forming the bags, such as reinforced plastics which are woven to form an open mesh bag or a burlap bag.

The bag may be of any open mesh construction or other wall construction which is perforated in a manner to allow the drying air in the kiln drying process to circulate about the pieces within the bag to remove the moisture therefrom. It is appreciated that in stacking the pieces 26 in the bag 30, spaces will normally form between the pieces so that air may circulate through the spaces amongst the wood in kiln drying all of the pieces within each bag.

The bags of wood 30 are stacked on a pallet 36 in the interlocking manner as demonstrated in FIG. 5, where the stack 35 is approximately five bags high. To secure the stacked bags in a vertical manner on the pallet, an open mesh netting 38 is wrapped around the vertical sides of the stack 35 and pallet 36. The open mesh 38 may be of a plastic material which can be wrapped one or more times around the stack to secure the stack in a vertical manner on the pallet. Due to the loose placement of the firewood pieces 26 in the bags 30, as they are stacked on the pallet 36 and due to the open mesh of netting 38, the circulating air may pass through the netting 38 and the open mesh of the bags 30 in travelling over the pieces 26 in removing moisture therefrom during the kiln drying process Several of the pallets 36 may be placed in a kiln 40 through door opening 42. A furnace or heater arrangement 44 withdraws air from its oven chamber 46 through vent 48. The air is heated in the furnace 44 and directed back into the chamber 46 via flue 50 in the direction of arrows 52. As is appreciated by those skilled in the art in kiln drying, deflectors and the like may be used for directing the air about the chamber 46 to effect proper air circulation in drying the stacks 35 in the chamber 46. Depending upon the moisture content of the air 54 exhausting through vent 48, some of the air may be removed and exhausted in the direction of arrows 56 to the atmosphere. This portion of the technique is conducted in accordance with standard wood kiln drying systems. The furnace 44, however, is set at a temperature in excess of normal kiln drying temperatures for dressed lumber. The air in the chamber 46 is initially in excess of 150° F. and is preferably greater than 175° F. and may range upwards of 200° F. or more depending upon the material used for the open mesh or perforated walls of the bag 30.

Figure 8:
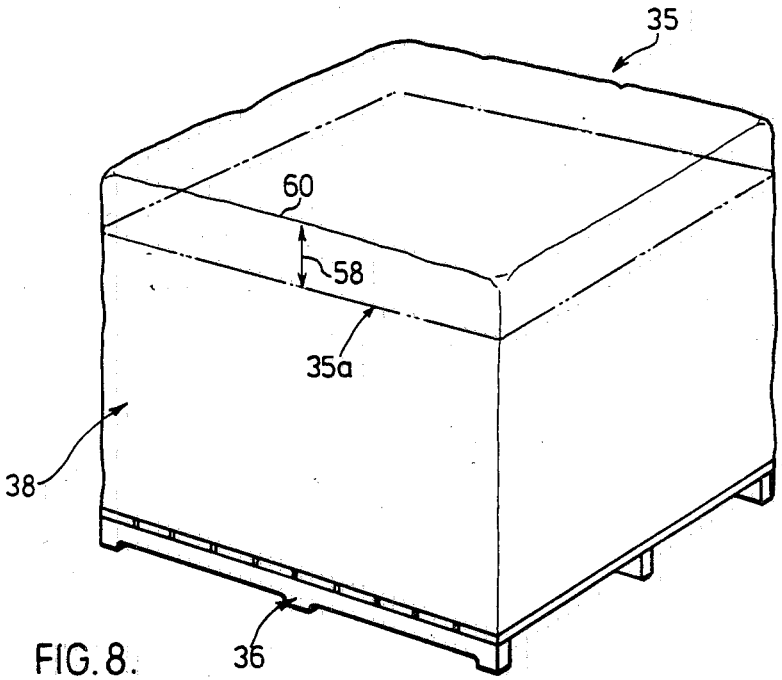
FIG. 8 demonstrates the vertical settling and shrinking of the stack of bagged, green firewood pieces as they are kiln dried.

Depending upon the size of the kiln oven 40, it is appreciated that several pallets of stacks 35 may be placed in the kiln, for example, in some installations up to 200 pallets of stacked, bagged firewood pieces may be kiln dried at one time. During the kiln drying process, the firewood pieces as they loose moisture tend to shrink resulting in a loss in vertical height of the stack of firewood. As shown in FIG. 8, the stack 35 had an initial height as shown in dark outline. During the kiln drying process, the vertical height was decreased to a level **35*a* as shown in dot and as represented by an arrow 58. By way of wrapping the exterior with open mesh netting 38, the bags of firewood may settle and remain on the pallet 36 without disturbing the stacks. The mesh 38**, as it is wrapped around the vertical sides, retains tension on the stack so that when picked up by a fork lift truck, the stacks of bags remain secure on the pallet.

Figure 6:
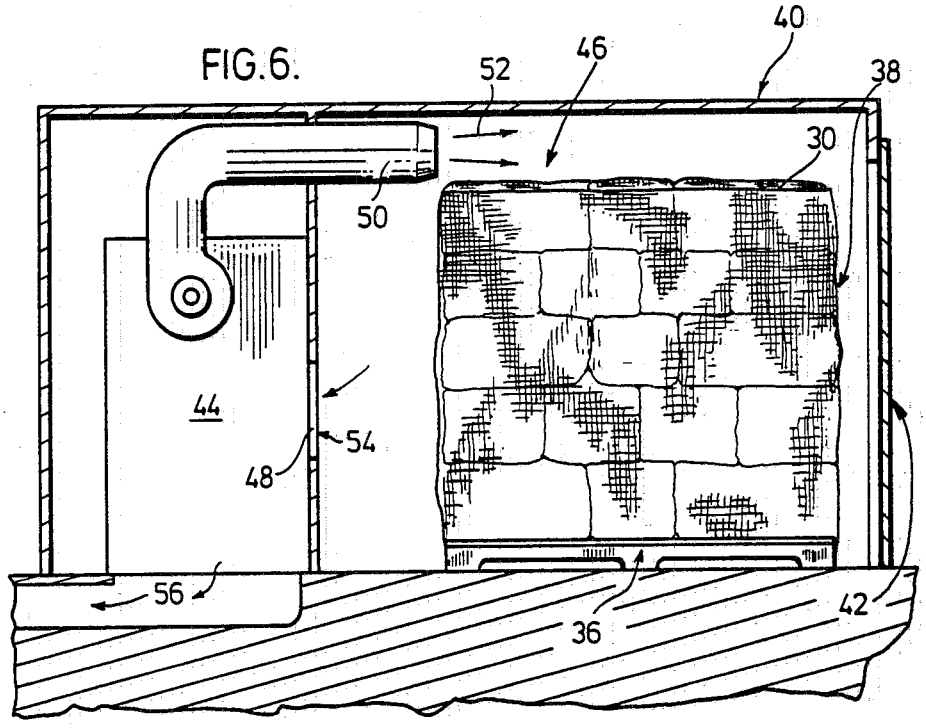
FIG. 6 is a section through a kiln drying unit for kiln drying the pallets placed in the oven.

In comparing FIGS. 6 and 8, it can be seen that initially the stacks of bags 30 on the pallet were slightly above the outer mesh wrapping 38. After the kiln drying process is complete, the firewood stack, as is show at line **35*a*, is below the upper edge 60 of the open mesh netting 38 which will simply fall over and lie on the upper surfaces of the bags 30 of the stack 35**.

Figure 7:
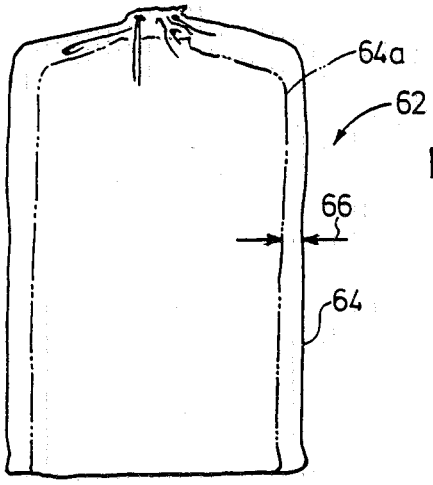
FIG. 7 is a side elevation of a thermoplastic bag which shrinks with the firewood pieces during drying.

In instances where the firewood to be dried results in considerable shrinkage due to moisture removal, then a filling of a bag 30, as shown in FIG. 4, can result in a very loose fitting bag of wood after the wood has been kiln dried. As shown in FIG. 7, a special bag 62 may be used having material 64 which is an oriented thermoplastic netting. By orienting the thermoplastic of the netting, when it is exposed to heat, it tends to shrink. Thus as the wood within the bag 62 shrinks, the bag walls 64 will shrink with the wood providing a snug fitting bag for the finished kiln dried wood, thereby providing a more marketable product. As demonstrated in FIG. 7, initially the bag 62 has the solid outline and after kiln drying of the contents, the bag has shrunk to the dotted outline at **64*a* to the extent indicated by arrows 66. Thus the dried firewood as it is displayed in the bag 62** still has the fullness appearance as when originally filled. It is appreciated that there are many forms of thermoplastic netting available which has been oriented so as to shrink when heated. An example of such netting may be that used in packaging loose consumer items, which are not affected by heat where the thermoplastic material is normally polyethylene or polypropylene.

The kiln drying operation, as exemplified in FIG. 6, is continued until the moisture content of the firewood pieces is in the range of 15% to 30% by weight. That is the overall moisture content of a firewood piece 26 may have 15% to 30% by weight of water and the weight of wood would correspondingly make up 85% down to 70% by weight of each piece. It has been discovered that in kiln drying the individual pieces, first of all due to the rapid removal of the moisture from the pieces of wood, checking or cracking 68 is induced into the section of the wood as shown in FIG. 3. Secondly, it has been found that in rapidly drying the wood, there is a moisture gradient developed across the section of the wood. An outer portion of each piece 26 which is sufficiently dry to permit ignition thereof by use of ignited paper or the like, does not require the use of smaller pieces of wood kindling which is not always available to the consumer. However, internally of each piece, the moisture content is considerably higher which is necessary to control the rate at which each piece burns. Thus the moisture gradient across the section of the wood, as produced by the kiln drying process, provides a significant advantage in igniting the wood and then providing sufficient moisture within the interior core of the wood to control the burn rate at that point and prolong its usefulness within the fireplace. Thus the moisture content of the outer layer may be in the range of 2% to 10%, whereas the interior portion of each piece of wood may be in the range of 20% to 30% and hence provide an overall moisture content in the range of 15% to 30%.

The technique of bagging the green firewood pieces, stacking the bags on a pallet and placing the pallets in a kiln is efficient from the standpoint of handling the firewood and not requiring elaborate kiln drying equipment. However depending upon the volume of wood to be processed, it is appreciated that once the wood is split to form the green firewood pieces 26, the conveyor 28 may be adapted by use of wire mesh or the like to pass the green pieces through a kiln drying tunnel, such that when the pieces emerge from the other end of the tunnel, they are at the desired dryness and provide the moisture gradient as previously discussed with respect to FIG. 3. The kiln drying tunnel would be of sufficient length and operated at various temperatures along the length to remove moisture from the wood at rapid rates to provide the desired product at the exit of the kiln drying tunnel. At the exit, the wood, once it is cooled, may be then placed in bags 30 for shipment. In this instance where the bags are not associated with the wood during the kiln drying process, the kiln may be operated at much higher temperatures considerably in excess of 200° F. and possibly up to 400° F. or even greater depending upon the surface ignition temperature of the wood which is being kiln dried.

It is appreciated that, in the instance where tunnel drying is used to dry the firewood, packaging other than the open mesh package of FIG. 4 may be used, such as cardboard boxes, strapping or the like to hold the kiln dried wood in bundle form. Whatever type of packaging is used, other than the mesh bags of FIG. 4, it should include perforated walls such as the packaging of Canadian Pat. No. 1,116,134.

It is also appreciated that the temperatures within the kiln 40, when the wood which is packaged in the shrink wrapping netting, must not exceed a level which can cause softening of the thermoplastic material so that the netting looses its shrink characteristics and degrades to the extent that the package could burst when handled. Also to insure shrinkage of the bag, the palletizing of the stack may be carried out in a manner so as to allow shrinkage of the packaging around the firewood. This may result in standing the bags of firewood on end so that there are two heights of vertically oriented bags, rather than stacking the bags on their sides. The vertical standing of the bags can be retained on the pallet by the use of appropriate wire or plastic mesh netting 38.

The process for kiln drying firewood provides an efficient manner of manufacturing firewood in avoiding the one to two years of normal time required in seasoning firewood. Now varying demands in the marketplace may be met, since green firewood as cut from a woodlot may be immediately processed and shipped within four or five days for use as firewood. Because the firewood logs do not lie around in the field, they do not become overly dirty since they can be cleaned before the splitting operation and once bagged, do not usually come in contact with dirt. Due to the wood being kiln dried, fungus and insects in the wood are immediately killed. It has also been found that there is a greater heat output from the wood as compared to normally seasoned wood and that the wood tends to burn with an even flame across its length thereby enhancing the appearance of the fire within the fireplace. It has also been found that less creosote is present in the wood thereby reducing the hazard of chimney fires.

The following example illustrates a preferred embodiment of the invention.

EXAMPLE I

Hard maple firewood logs, as freshly cut, were split and bagged and kiln dried at a temperature of 200° F. for approximately 48 to 72 hours. Subsequently, pieces were removed from the bag and analyzed for moisture content. The moisture content of the pieces, as removed from the bag, ranged from 20.8% up to 22.8% by weight water and the remainder wood. It was found that a fifty pound bag of kiln dried wood had a heating value of approximately 410,710 BTU's which was approximately 8,310 BTU's per pound of wood with a percent ash content of 1.31% by weight.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A process for kiln drying firewood consisting of essentially uniform lengths of split firewood pieces, said process comprising splitting essentially uniform lengths of green tree logs to form firewood pieces, placing said firewood pieces in open mesh bags to provide a plurality of bags of firewood, placing said plurality of bags of green firewood pieces in a kiln drying oven, kiln drying said pieces at temperatures in excess of 150° F. by moving heated air over the pieces until said pieces have an overall moisture content ranging from 15% up to 30% by weight, operating said kiln at a temperature below a level which would render the structural characteristics of the bag useless and removing said kiln dried firewood pieces in said plurality of bags from said kiln drying oven.

2. A process of claim 1, wherein said bag is made of an open mesh thermoplastic polyproplyene material, operating said oven at a temperature in the range of 175° to 200° F.

3. A process of claim 1, wherein said thermoplastic polyprolyene material is oriented to provide for a shrink characteristic in the material when heated, operating said oven at a temperature in the range of 175° F. to 200° F. to induce shrinkage in said open mesh bag and thereby continue to snugly retain said firewood pieces as the pieces shrink during the kiln drying process.

4. A process of claim 1, wherein several of said firewood pieces are placed in a bag of predetermined volume after the pieces are split from a green tree log, said bag having a perforated wall to permit air circulation therethrough, preparing several of said bags and stacking said bags onto a pallet, securing said bags on said pallet, placing a plurality of said pallets in said kiln drying oven and drying said pieces to the extent desired and removing said pallets from said oven.

5. A process of claim 4, wherein said stacked bags are secured on said pallet by wrapping a netting vertically about the sides of said stack of bags, said wrapping allowing said stack of bags to decrease in height during the kiln drying process while said bags are contained on said pallet by said netting.

6. A process of claim 1 wherein said tree logs were obtained from a tree cut down for less than one week.

7. A process of claim 6, wherein said split firewood pieces are kiln dried for two to three days at temperatures ranging from 175° F. to 200° F.

8. A process of claim 7, wherein said firewood pieces are dried to an extent to provide a moisture content in a layer of each firewood piece which is sufficiently dry to permit ignition of two or more pieces with ignited paper and having a higher moisture content in the interior layers of the piece to control burning rate of the piece once it is ignited.

9. A process of claim 8, wherein said outer layer of each piece has a moisture content in the range of 2% to 7% by weight.

10. A process of claim 8 or 9, wherein the moisture content in the interior layer of each piece is greater than the overall moisture content of the split piece of firewood.

* * * * *